US008023550B2

(12) United States Patent
Döbbeler

(10) Patent No.: US 8,023,550 B2
(45) Date of Patent: Sep. 20, 2011

(54) REACTANCE BALLAST DEVICE

(75) Inventor: Arno Döbbeler, Herzogenaurach (DE)

(73) Assignee: Siemens Aktiengesellschaft, Munich (DE)

( * ) Notice: Subject to any disclaimer, the term of this patent is extended or adjusted under 35 U.S.C. 154(b) by 30 days.

(21) Appl. No.: 12/447,009

(22) PCT Filed: Aug. 31, 2007

(86) PCT No.: PCT/EP2007/059120

§ 371 (c)(1),
(2), (4) Date: Aug. 31, 2009

(87) PCT Pub. No.: WO2008/049680

PCT Pub. Date: May 2, 2008

(65) Prior Publication Data

US 2010/0033285 A1 Feb. 11, 2010

(30) Foreign Application Priority Data

Oct. 26, 2006 (DE) ..... 10 2006 050 624

(51) Int. Cl.

| | |
|---|---|
| ***F27D 1/00*** | (2006.01) |
| ***H05B 7/148*** | (2006.01) |
| ***H05B 7/144*** | (2006.01) |
| ***H05B 7/18*** | (2006.01) |

(52) U.S. Cl. ..... 373/71; 373/102; 373/104; 373/60

(58) Field of Classification Search ..... 373/60, 373/71, 102–105, 8–9, 144

See application file for complete search history.

(56) References Cited

U.S. PATENT DOCUMENTS

| | | | | |
|---|---|---|---|---|
| 1,839,148 | A | 12/1931 | Greene | |
| 3,410,946 | A | 11/1968 | Dilling et al. | |
| 4,677,643 | A * | 6/1987 | Dicks | 373/105 |
| 5,012,487 | A * | 4/1991 | Simcock | 373/147 |
| 6,337,802 | B1 * | 1/2002 | Larsson et al. | 363/127 |
| 2007/0247135 | A1 * | 10/2007 | Koga | 323/344 |
| 2008/0192409 | A1 * | 8/2008 | Roscizewski et al. | 361/605 |
| 2009/0219968 | A1 * | 9/2009 | Perry et al. | 373/104 |

FOREIGN PATENT DOCUMENTS

| | | |
|---|---|---|
| DE | 1009735 | 6/1957 |
| DE | 19508267 | 7/1996 |
| DE | 102004052316 | 12/2005 |
| EP | 0429774 | 6/1991 |
| FR | 2561466 | 9/1985 |
| GB | 1240056 | 7/1971 |
| WO | 2006024149 | 3/2006 |

OTHER PUBLICATIONS

German Office Action for Application No. 10 2006 050 624.3 (4 pages), Jul. 26, 2007.

International Search Report and Written Opinion for Application No. PCT/EP2007/059120 (10 pages), Nov. 9, 2007.

* cited by examiner

*Primary Examiner* — Anh Mai
(74) *Attorney, Agent, or Firm* — King & Spalding L.L.P.

(57) ABSTRACT

A reactance ballast device (V), in particular for an arc furnace, has an induction coil (1) and a free-standing load stepping switch (2), with the load stepping switch (2) being designed to adjust the reactance of the induction coil (1) while on load. A transformer (T), in particular for an arc furnace (O), has an associated reactance ballast device (V) of the type mentioned initially. An arc furnace (O), in particular for steel smelting, is preceded by a transformer (T) such as this.

21 Claims, 3 Drawing Sheets

REACTANCE BALLAST DEVICE

CROSS REFERENCE TO RELATED APPLICATIONS

This application is a United States national phase filing under 35 U.S.C.§371 of International Application No. PCT/EP2007/059120, filed Aug. 31, 2007 which claims priority to German Patent Application No. 10 2006 050 624.3, filed Oct. 26, 2006. The complete disclosure of the above-identified application is hereby fully incorporated herein by reference.

TECHNICAL FIELD

The invention relates to a reactance ballast device for an arc furnace, in particular for setting the additional reactance of a transformer of the arc furnace.

BACKGROUND

An arc furnace, as is used, for example, for melting steel, generally has a transformer connected upstream of it, which transformer sets an AC voltage required for the arc. Since very high powers are consumed by an arc furnace and high AC voltages need to be transmitted by the transformers connected upstream, such transformers are generally introduced into an insulating material in order to avoid flashovers.

An important characteristic in the case of AC voltage and alternating current is the reactance, i.e. the reactance of a conductor, for example in the case of a coil through which current is flowing.

For various operational states of an arc furnace it is desirable to be able to set different reactances. For this purpose it is known to integrate an apparatus for setting the reactance with an induction coil and with an on-load tap changer in the transformer which is connected upstream. Typically, such apparatuses with the coils and the active part of the transformer are introduced into a tank filled with insulating material.

It is further known for an arc furnace plant without an additional reactance introduced into the transformer tank to use air-core induction coils positioned outside the transformer, for example in an outdoor switchgear assembly, as the additional reactance.

However, it is not possible to use additional reactances designed in this way to set an optimum reactance for all operational states of the arc furnace on load.

Many arc furnace plants are therefore operated in practice with a fixedly preselected reactance. The induction coil used for this purpose has at least one tap, which taps off the current flowing through the coil after a specific turns number and therefore assigns a reactance which is set in a defined manner to the transformer. For assignment of the desired reactance, the tap has fixed wiring. However, it is necessary for a change to be made if it is identified after a relatively long period of operation that the selected series reactance has not been optimally set during operation on load, i.e. during operation of the furnace, which results, for example, in an unnecessary increase in the consumption of energy, or that the reactance should be matched in a process-dependent manner. It is disadvantageously necessary for this purpose for the power supply to be switched off, and therefore for the furnace plant to be shut down and for the transformer to be wired to another tap on the induction coil.

SUMMARY

According to various embodiments, an apparatus can be specified which makes it possible to easily set the reactance connected upstream in particular of a transformer.

According to other embodiments, a transformer can be specified which can be used to set the reactance as precisely as possible.

According to yet other embodiments an arc furnace can be specified, in particular for melting steel, which is supplied with energy in a manner which is as optimal and economical as possible during operation on load.

According to an embodiment, a reactance ballast device, in particular for an arc furnace, may comprise an induction coil and a free-standing on-load tap changer, the on-load tap changer being formed and designed to set the reactance of the inductance coil on load.

According to a further embodiment, the induction coil can be in the form of a free-standing dry-insulated air-core induction coil. According to a further embodiment, the induction coil may be provided with a number of tapping points, each of which has an assigned turns number of the induction coil. According to a further embodiment, the on-load tap changer may comprise a number of input contacts, at least one output contact and a switching element, which switching element may be designed in each case to connect at least one input contact to an output contact, and a container with an insulated material, which container mat be formed and designed to accommodate the switching element. According to a further embodiment, the switching element may have a number of inputs and at least one output, one or each output having an assigned branching node, at which at least two branches of a bridge circuit converge, the branches in each case being capable of being deactivated at switching points, the branches in each case being capable of being connected variably to the inputs, and in each case being connected in pairs to a load switching point, in particular to a vacuum interrupter, via a cross connection. According to a further embodiment, the number of tapping points of the induction coil may correspond to the number of input contacts of the on-load tap changer and in each case one tapping point may be connected to an input contact. According to a further embodiment, the input and the output contacts of the on-load tap changer may be uniquely assigned to the inputs and outputs of the switching element, respectively.

According to another embodiment, a transformer, in particular for an arc furnace, may have an assigned reactance ballast device as defined above for presetting the reactance.

According to a further embodiment, and additional apparatus for setting the reactance with an induction coil and with an on-load tap changer may be integrated in the transformer.

According to yet another embodiment, an arc furnace, in particular for melting steel, may have a transformer as defined above connected upstream of said arc furnace.

BRIEF DESCRIPTION OF THE DRAWINGS

An exemplary embodiment will be explained in more detail below with reference to a drawing, in which, in each case in a schematic illustration.

DETAILED DESCRIPTION

Figure 1:
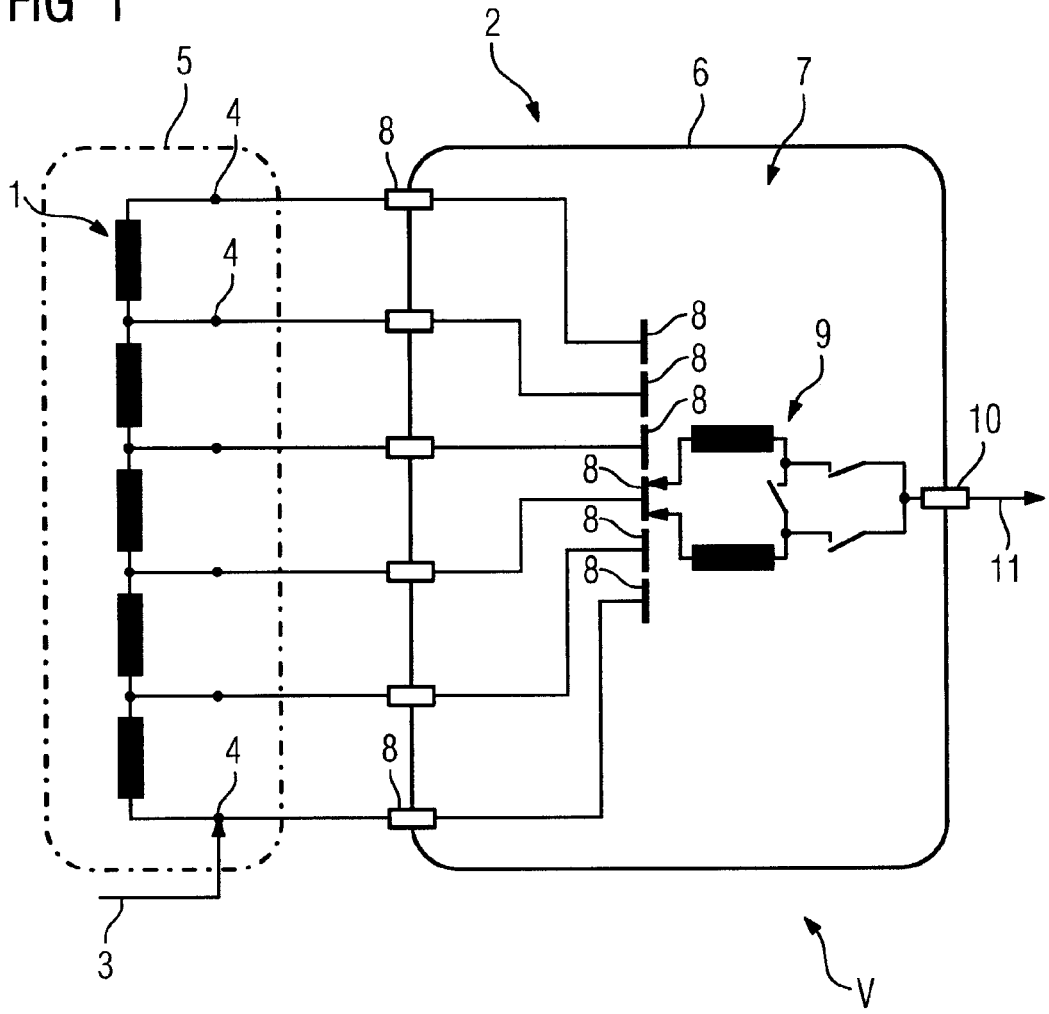
FIG. 1 shows a reactance ballast device with an air-core induction coil and an on-load tap changer.

According to various embodiments, a reactance ballast devise is specified, in particular for an arc furnace, with an induction coil and with a free-standing on-loading tap changer, the on-load tap changer being formed and designed to set the reactance of the induction coil on load.

The combination of an induction coil with a free-standing on-load tap changer in accordance with an embodiment makes it possible to set the series reactance on load, with the result that the optimum series or additional reactance can always be selected corresponding to the operational requirements, in particular when applied to the operation on load of an arc furnace.

The reactance ballast device is not restricted to the use thereof for setting the reactance for an arc furnace or for a transformer of an arc furnace. It can also be connected upstream of other energy consumers or plants, whose characteristics are determined in particular by the reactance.

Advantageously, a free-standing dry-insulated air-core induction coil may be selected for the reactance ballast device. Dry-insulated air core induction coils do not make use of any insulating oils, as a result of which the general complexity in terms of maintenance and risk of fire is reduced and thus the efficiency and environmental friendliness is increased.

Furthermore, the induction coil has a suitable number of tapping points, each of which has an assigned turns number of the coil. Since the inductance and therefore the impedance of a coil depends on the number of turns through which a coil current passes, tapping of the alternating current passing through the coil at a tapping point can be used to predetermine the coil impedance and therefore the reactance, i.e. the reactance in the case of alternating current, in graduated fashion, corresponding to the graduations of the tapping points.

In a development of the reactance ballast device, the free-standing on-load tap changer combined with the induction coil has a number of input contacts, at least one output contact and a switching element. In this case, the switching element is designed to alternately and variably connect at least one input contact to an output contact. In the case of a plurality of input contacts, the switching element can therefore connect in each case one or more input contacts to an output contact, depending on the configuration. By respective setting of the switching element, the output at the or at an output contact is therefore controlled. The on-load tap changer also comprises a container with an insulating material, which container is formed and designed to accommodate the switching element. The insulating material avoids a flashover as a result of high voltages. The insulating properties of the insulating material reduces the spark gap, with the result that the physical size is overall reduced.

The switching element correspondingly has a number of inputs and at least one output, with one or each output having an assigned branching node, at which at least two branches or a bridge circuit converge, the branches in each case being capable of being deactivated at switching points, the branches in each case being capable of being connected variably to the inputs, and in each case being connected in pairs to a load switching point, in particular to a vacuum interrupter, via a cross connection.

At the branching node assigned to an output of the switching element, the branches belonging to a bridge circuit converge, with a bridge circuit comprising at least two branches. The branches produce the contact to the inputs of the switching element, and in the process can be contact-connected individually to various inputs, with the result that a plurality of branches is present at one input or only in each case one branch is present at each input. In particular, the variable contact-making can be achieved by the branches being shifted between various inputs. If all of the branches are present at one input or all of the branches are in contact with this input, a step position is predetermined. If, on the other hand, two branches are present at two different inputs, a bridge position is defined. In the case of only two branches, there is only one step position and one bridge position. A switching element formed in such a way makes it possible to switch on load, the switching from one step position to another taking place successively via the formation of bridge positions.

The branches of the bridge circuit of the switching element are connected in pairs to cross connections, which can be deactivated via in each case one load switching point. For their part the branches are each provided with switching points between the branching nodes and the cross connections. If switching points on individual branches are now deactivated, for example in order to shift these branches from in each case one to in each case another input, the cross connections connected to these branches first take over the load and additionally can compensate for current and voltage fluctuations in the region of the branching node and prevent overloads from occurring there during switching. Now, the cross connections can be deactivated at the load switching points and the branches which have thus been decoupled from the current flow can be shifted. The load switching points are preferably provided by vacuum interrupters since vacuum interrupters function reliably as load switches as a result of the shielding effect of the vacuum and are subject to little wear. In addition, expediently the branches between the cross connections and the input-side contact points are provided with induction elements, which ensure a substantially uniform load distribution in the circuit in a bridge configuration.

A desired configuration of the reactance ballast device is to this extent one in which the number of tapping points of the induction coil corresponds to the number of input contacts of the on-load tap changer and in each case one tapping point is connected to an input contact. In this case, the assignment of the tapping points to the input contacts is preferably linear, with the result that counting of the input contacts in a predetermined sequence corresponds to the increasing or decreasing reactance of the induction coil. There is therefore a desired unique assignment between the reactance steps and the input contacts.

Furthermore, a unique assignment between the input and output contacts of the on-load tap changer and the inputs and outputs of the switching element is expediently provided. Thus in particular the inputs of the switching element are uniquely assigned to the reactance steps. The switching element as part of the on-load tap changer therefore represents series reactance matching of the transformer via the choice of steps of the tapping points of the induction coil.

According to a further embodiment, a transformer, in particular for an arch furnace, may have an assigned reactance ballast device in accordance with the type mentioned at the outset.

An additional apparatus for setting the reactance with an induction coil and with an on-load tap changer is advantageously integrated in the transformer.

According to yet another embodiment, an arc furnace, in particular for melting steel, may have a transformer of the abovementioned type connected upstream of said arc furnace.

FIG. 1 illustrates a reactance ballast device V with an air-core induction coil 1 and with a free-standing on-load tap changer 2, as a whole. The air-core induction coil 1 is connected to a mains power supply via the feed point 3 and has been provided with a number of uniformly distributed tapping points 4, via which the current flowing through the air-core induction coil 1 can in each case be tapped off after a multiple of a uniformly sized subsection of the coil flow. If appropriate, the air-core induction coil 1 is introduced into a container 5, which in this case is illustrated by dashed lines.

The free-standing on-load tap changer 2 has a steel housing 6, whose interior 7 has been filled with an insulating material, in particular oil. The on-load tap changer 2 has been provided with a number of input contacts 8, which are wired to the tapping points 4 of the air-core induction coil 1. In the interior 7 of the steel housing 6, the input contacts 8 represent inputs for a switching element 9 which is localized there and which in this case can be shifted variably as a whole. The output of the switching element 9 is passed to the outside via an output contact 10 and is connected to a transformer of an arc furnace via a mains line 11. As a result of a defined shift of the switching element 9 with respect to a specific input contact 8 and the corresponding tapping point 4, the load circuit of the reactance ballast device V is closed between the feed point 3 and the output line 11. Thus, the reactance 4 assigned to the tapping point 4 of the air-core induction coil 1 is made available at the output line 11.

Figure 2:
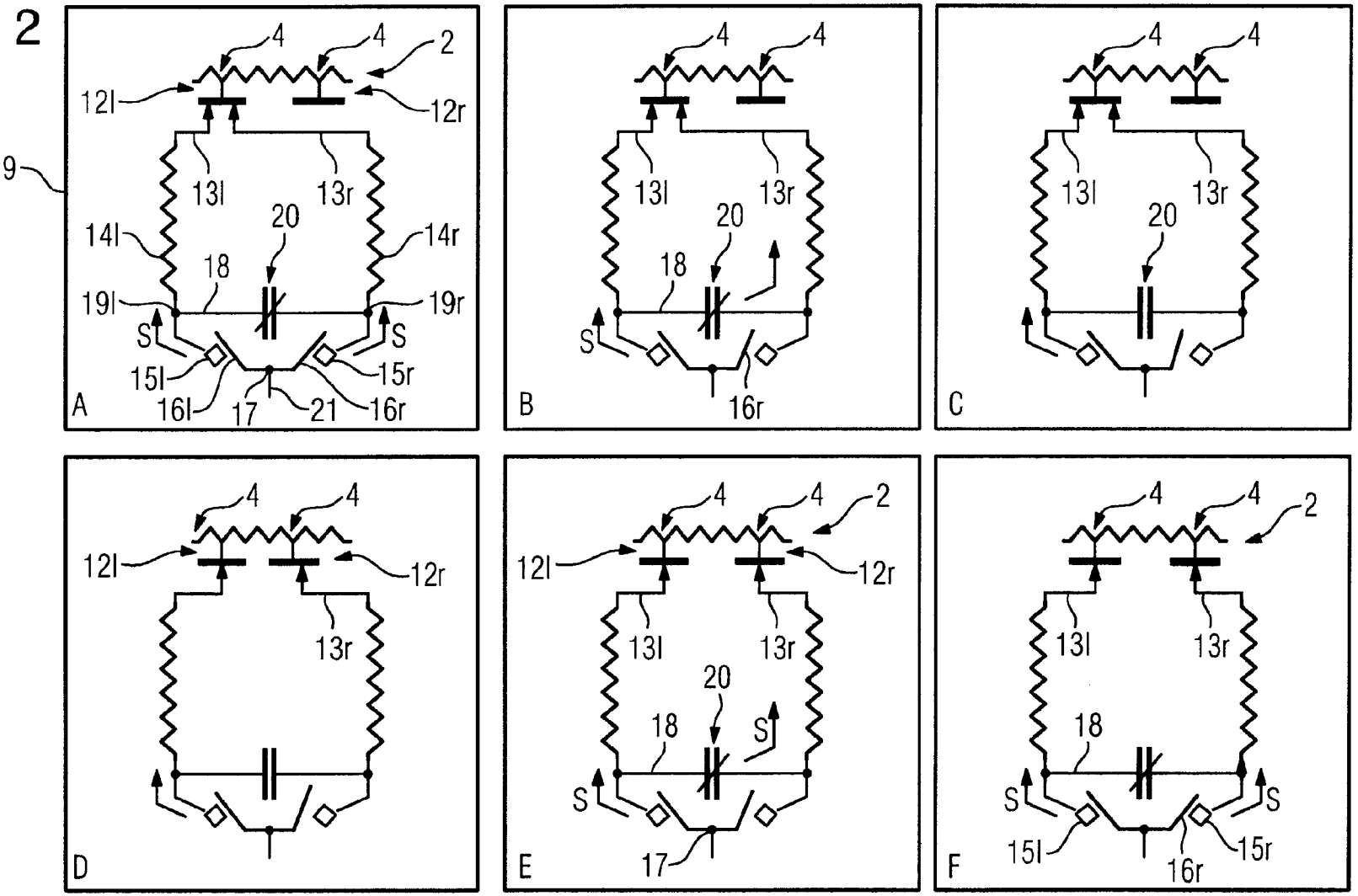
FIG. 2 shows the switching process of a switching element between a step position and a bridge position in six individual figures A to F.

FIG. 2 shows a schematic illustration of the switching process of a switching element 9 shown in FIG. 1 between a step position and a bridge position in the switching phases A to F. First of all the components of the switching element 9 will be explained in detail with reference to the figure relating to switching phase A which components have been provided in similar fashion for the remaining switching phases B to F. For reasons of clarity, the components of the switching element 9 have only been provided with reference symbols in the figures relating to switching phases B to F where it is necessary for explaining the switching process.

The switching element 9 illustrated in FIG. 2 is connected to the tapping point 4 of the air-core induction coil 1 via the on-load tap changer 2, as can be seen in FIG. 1. FIG. 2 illustrates two inputs 12*l*, 12*r* of the switching element 9, which are assigned to the input contacts 8 of the on-load tap changer 2 in FIG. 1. In the illustration, the switching element 9 has a left-hand line branch or branch 13*l* and a right-hand line branch or branch 13*r*, which have each been provided with induction coils 14*l*, 14*r*, and are each connected to toggle switches 16*l*, 16*r* with a branching node 17 via contact points 15*l*, 15*r*. The branching node 17 leads to the output 21 of the switching element 9. In each case between the induction coils 14*l*, 14*r* and the contact points 15*l*, 15*r* there is a cross connection 18 with a vacuum interrupter 20 between the line branches 13*l* and 13*r*, which are each connected thereto at the connection points 19*l* and 19*r*. The arrows S indicate the inverse direction of flow.

The switching operation can be seen from the individual switching phases A to F:

A The switching element 9 is located in step position at the input 12*l*. Both branches 13*l* and 13*r* are at the input 12*l*. The toggle switches 16*l* and 16*r* are in the closed position at the respective contact points 15*l* and 15*r*, with the result that the two branches 13*l* and 13*r* are on load. The induction coils 14*l* and 14*r* ensure a symmetrical load distribution between the branches 13*l* and 13*r*.

B The toggle switch 16*r* is opened, and the contact is capped at the contact point 15*r*. As a result, the cross connection 18 is on load via the closed vacuum interrupter 20.

C The vacuum interrupter 20 is interrupted, and the branch 13*r* is off load and can be shifted; the entire load is on the branch 13*l*.

D The off-load branch 13*r* is shifted from the input 12*l* to the input 12*r*.

E The vacuum interrupter 20 is closed; the cross connection 18 and the branch 13*r* are on load again; the bridge position is active since the inputs 12*l* and 12*r* now simultaneously produce a closed cycle via the branching point 17.

F The toggle switch 16*r* is closed again; the contact is produced again at the contact point 15*r*. The bridge position is realized via the two contact points 15*l* and 15*r*, instead of via the cross connection 18.

In the inverse sequence with respect to the sequence A to F and mirror-symmetrically with respect thereto, the branch 13*l* can now be shifted in order to produce a step position of the two branches 13*l*, 13*r* at the input 12*r*.

In this way, the bridge circuit of the switching element 9 via the formation of bridge positions at various inputs makes it possible to shift from step position to step position between these various inputs on load.

Figure 3:
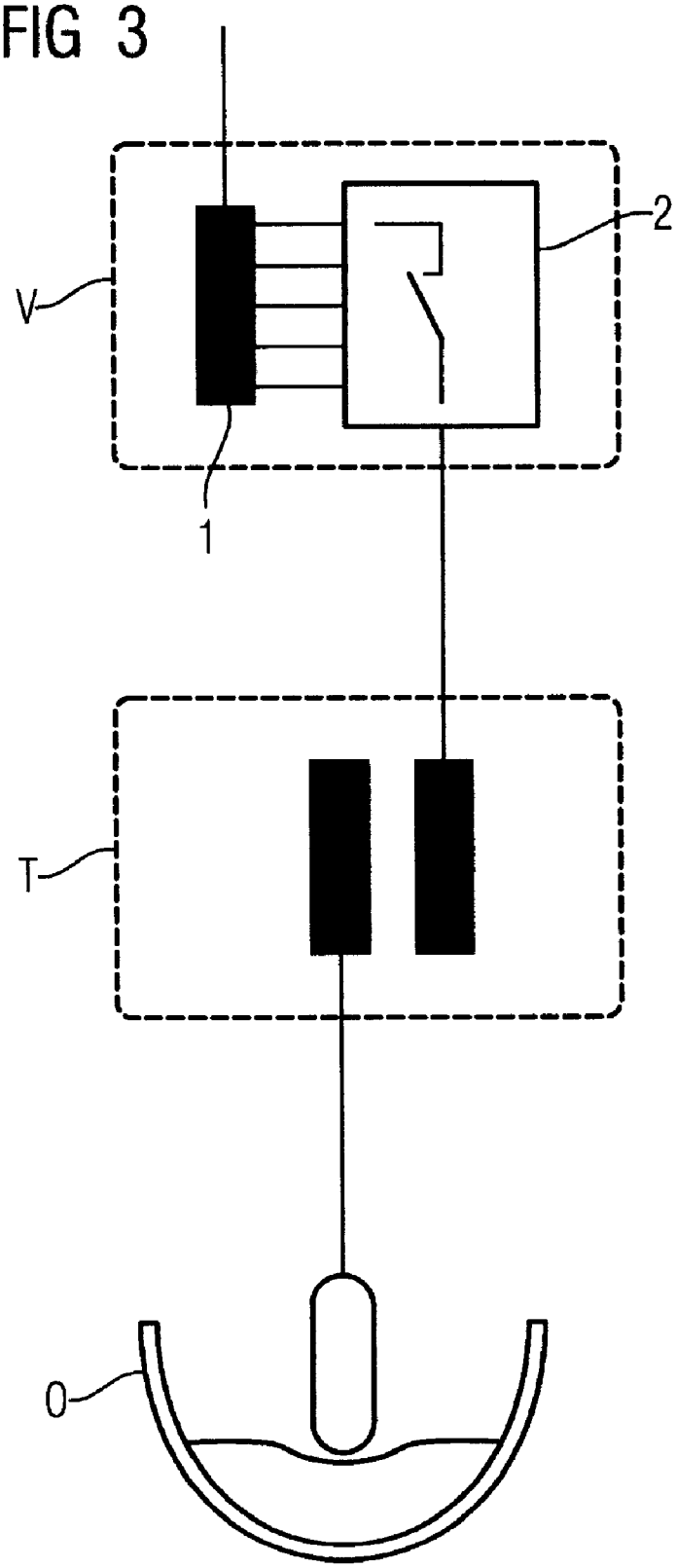
FIG. 3 shows a single-line schematic of an arc furnace with a transformer and a reactance ballast device of the type mentioned at the outset.

FIG. 3 shows an arc furnace O with a furnace transformer T and a reactance ballast device V of the type mentioned at the outset with an induction coil 1 and an on-load tap changer 2.

The invention claimed is:

1. A reactance ballast device comprising an induction coil and a free-standing on-load tap changer;

wherein the on-load tap changer is formed and designed to set the reactance of the induction coil on load;

wherein the induction coil is provided with a number of tapping points, each of which has an assigned turns number of the induction coil;

wherein the on-load tap changer comprising a number of input contacts, at least one output contact, a switching element for connecting at least one input contact to an output contact, and a container with an insulating material, the container accommodating the switching element;

wherein the switching element has a number of inputs and at least one output, at least one output having an assigned branching node at which at least two branches of a bridge circuit converge, wherein each branch is capable of being deactivated at a switching point, wherein each branch is capable of being connected variably to the inputs, and wherein the branches are connected to a load switching point via a cross connection; and wherein the number of tapping points of the induction coil corresponds to the number of input contacts of the on-load tap changer with each tapping point being connected to an input contact.

2. A reactance ballast device comprising an induction coil and a free-standing on-load tap changer;

wherein the on-load tap changer is formed and designed to set the reactance of the induction coil on load;

wherein the on-load tap changer comprises a number of input contacts, at least one output contact, a switching element for connecting at least one input contact to an output contact, and a container with an insulating material, the container accommodating the switching element; and wherein the switching element has a number of inputs and at least one output, at least one output having an assigned branching node at which at least two branches of a bridge circuit converge, wherein each branch is capable of being deactivated at a switching point, wherein each branch is capable of being connected variably to the inputs, and wherein the branches are connected to a load switching point via a cross connection, and wherein the branches are connected to a vacuum interrupter via a cross connection.

3. An arc furnace comprising:

a transformer comprising an assigned reactance ballast device, the reactance ballast device comprising:

a feed point;

an induction coil;

a free-standing on-load tap changer; and an output contact;

wherein the induction coil is connected to the feed point;

wherein the on-load tap changer is connected between the induction coil and the output contact; and wherein the on-load tap changer is formed and designed to set the reactance of the induction coil on load.

4. The arc furnace according to claim 3, wherein the arc furnace is operable to melt steel.

5. A reactance ballast device comprising:

a feed point;

an induction coil;

a free-standing on-load tap changer; and an output contact;

wherein the induction coil is connected to the feed point;

wherein the on-load tap changer is connected between the induction coil and the output contact; and wherein the on-load tap changer is formed and designed to set the reactance of the induction coil on load.

6. The reactance ballast device according to claim 1, the induction coil being in the form of a free-standing dry-insulated air-core induction coil.

7. The reactance ballast device according to claim 1, the induction coil being provided with a number of tapping points, each of which has an assigned turns number of the induction coil.

8. The reactance ballast device according to claim 1, the on-load tap changer comprising a number of input contacts, at least one output contact and a switching element, which switching element is designed in each case to connect at least one input contact to an output contact, and a container with an insulating material, which container is formed and designed to accommodate the switching element.

9. The reactance ballast device according to claim 7, wherein the on-load tap changer comprising a number of input contacts, at least one output contact and a switching element, which switching element is designed in each case to connect at least one input contact to an output contact, and a container with an insulating material, which container is formed and designed to accommodate the switching element, and the number of tapping points of the induction coil corresponding to the number of input contacts of the on-load tap changer and in each case one tapping point being connected to an input contact.

10. The reactance ballast device according to claim 9, the input and the output contacts of the on-load tap changer being uniquely assigned to the inputs and outputs of the switching element, respectively.

11. The reactance ballast device according to claim 7, wherein the on-load tap changer comprising a number of input contacts, at least one output contact and a switching element, which switching element is designed in each case to connect at least one input contact to an output contact, and a container with an insulating material, which container is formed and designed to accommodate the switching element, wherein the switching element having a number of inputs and at least one output, one or each output having an assigned branching node, at which at least two branches of a bridge circuit converge, the branches in each case being capable of being deactivated at switching points, the branches in each case being capable of being connected variably to the inputs, and in each case being connected in pairs to a load switching point via a cross connection, and wherein the number of tapping points of the induction coil corresponding to the number of input contacts of the on-load tap changer and in each case one tapping point is connected to an input contact.

12. The reactance ballast device according to claim 8, the switching element having a number of inputs and at least one output, one or each output having an assigned branching node, at which at least two branches of a bridge circuit converge, the branches in each case being capable of being deactivated at switching points, the branches in each case being capable of being connected variably to the inputs, and in each case being connected in pairs to a vacuum interrupter via a cross connection.

13. The reactance ballast device according to claim 8, the switching element having a number of inputs and at least one output, one or each output having an assigned branching node, at which at least two branches of a bridge circuit converge, the branches in each case being capable of being deactivated at switching points, the branches in each case being capable of being connected variably to the inputs, and in each case being connected in pairs to a load switching point via a cross connection.

14. A transformer for an arc furnace, comprising:

an assigned reactance ballast device comprising:

a feed point;

an induction coil;

a free-standing on-load tap changer; and an output contact;

wherein the induction coil is connected to the feed point;

wherein the on-load tap changer is connected between the induction coil and the output contact; and wherein the on-load tap changer is formed and designed to set the reactance of the induction coil on load.

15. The transformer according to claim 14, the induction coil being provided with a number of tapping points, each of which has an assigned turns number of the induction coil.

16. The transformer according to claim 15, wherein the on-load tap changer comprises a number of input contacts, at least one output contact and a switching element, which switching element is designed in each case to connect at least one input contact to an output contact, and a container with an insulating material, which container is formed and designed to accommodate the switching element and the number of tapping points of the induction coil corresponding to the number of input contacts of the on-load tap changer and in each case one tapping point being connected to an input contact.

17. The transformer according to claim 16, the input and the output contacts of the on-load tap changer being uniquely assigned to the inputs and outputs of the switching element, respectively.

18. The transformer according to claim 14, the on-load tap changer comprising a number of input contacts, at least one output contact and a switching element, which switching element is designed in each case to connect at least one input contact to an output contact, and a container with an insulating material, which container is formed and designed to accommodate the switching element.

19. The transformer according to claim 14, the switching element having a number of inputs and at least one output, one or each output having an assigned branching node, at which at least two branches of a bridge circuit converge, the branches in each case being capable of being deactivated at switching points, the branches in each case being capable of being connected variably to the inputs, and in each case being connected in pairs to a load switching point, in particular to a vacuum interrupter, via a cross connection.

20. The transformer according to claim 14, comprising an additional apparatus for setting the reactance with an induction coil and an on-load tap changer being integrated in the transformer.

21. The transformer according to claim 14, the induction coil being in the form of a free-standing dry-insulated air-core induction coil.

* * * * *